United States Patent [19]

Still

[11] 4,404,536

[45] Sep. 13, 1983

[54] ELECTRICAL FUSE

[75] Inventor: Wolfgang Still, Herdecke, Fed. Rep. of Germany

[73] Assignee: Wickmann-Werke AG, Witten-Annen, Fed. Rep. of Germany

[21] Appl. No.: 183,921

[22] Filed: Sep. 3, 1980

[30] Foreign Application Priority Data

Sep. 6, 1979 [AT] Austria ..... 5896/79

[51] Int. Cl.[3] ..... H01H 85/02

[52] U.S. Cl. ..... 337/201; 337/206; 337/241

[58] Field of Search ..... 337/241, 198, 201, 206, 337/262, 264, 290, 292, 295

[56] References Cited

U.S. PATENT DOCUMENTS

| | | | |
|---|---|---|---|
| Re. 29,430 | 10/1977 | Plasko | 337/186 X |
| 4,023,265 | 5/1977 | Aryamane | 337/295 X |
| 4,056,884 | 11/1977 | Williamson et al. | 337/295 X |
| 4,067,103 | 1/1978 | Ciemier | 337/295 |
| 4,131,869 | 12/1978 | Schmidt et al. | 337/295 X |

*Primary Examiner*—George Harris

*Attorney, Agent, or Firm*—Robert E. Burns; Emmanuel J. Lobato; Bruce L. Adams

[57] ABSTRACT

A fuse comprises a flat carrier panel (2) which carries a fusible conductor (8) interconnecting two electrical contactors (7). A cover (11) is fitted onto the carrier panel (2) by means of integral legs (14) which snap around opposed edge portions (4') of the carrier panel to enclose the fusible conductor (8) within an insulating housing. The contactors (7) extend out of the housing to provide external connections for the fuse.

20 Claims, 17 Drawing Figures

ELECTRICAL FUSE

The invention relates to a fuse, in particular for printed circuits, comprising at least one fusible conductor within a housing of insulating material, which is composed of a carrier and a cover attachable to the carrier, the fusible conductor connecting in the housing spaced contactors which extend out of the housing for connecting the fuse into an electrical circuit. Such a fuse is hereinafter referred to as of the kind described.

The carrier of a known fuse of this kind (West German O/S No. 19 63 648) consists, in the assembled state, of a box-shaped or chamber-like housing which can be closed by a likewise box-shaped cover in which pairs of holding straps are provided for mounting the fusible conductor. When the cover is inverted over the chamber-like carrier the fuse element used as the fusible conductor and mounted in the cover is brought up to receiver contacts arranged inside the carrier and at the same time the carrier housing is covered up. There are certain advantages of this type of construction. However in certain other applications, this known fuse, because of the box-like structure of its housing, of the mounting for the fusible insert in the cover and of the mounting of the receiver contacts, requires a relatively large amount of space for mounting in its position of use, for example into a frame or against a wall. Thus fuse is also costly and is unsuitable for use with printed circuits where cramped space conditions exist.

The problem therefore exists of constructing a fuse of the kind described in such a way that the manufacturing outlay is considerably reduced, particularly the expenditure of energy for producing the necessary connections between the components, and providing a construction suitable for use with printed circuits boards.

In accordance with the invention, in a fuse of the kind described, the carrier is in the form of a panel of flat material; the contactors are clamped firmly onto the edge of the carrier; and the cover has spacer projecting parts resting against the carrier to provide a clearance between the cover and the surface of the carrier to accommodate the fusible conductor, and projecting catch members for providing the attachment of the cover to the carrier.

These features characterize a type of fuse which differs significantly from the construction of the fuse known from the West German O/S No. 19 63 648. The panel-like construction of the carrier from flat material allows a lower structural height and at the same time a considerable simplification in manufacture. The contactors in contrast to those of the known fuses are clamped firmly in a simple manner onto the edge of the carrier, the ends of the contactors preferably projecting from the underside of the carrier for plugging into printed circuit boards. In order nevertheless to achieve the desired covering up to the fusible conductor, a cover is employed which, by means of spacer projecting parts which rest against the carrier and which may consist, for example, of a sidewall of the cover, can be located with a panel parts of the cover spaced a small distance from the surface of the carrier so that the fusible conductor can extend freely at least in its zone of fusion. Irrespective of whether there extends between the contactors a fusible thread or respectively a fusible wire or fusible strip, this new space-saving type of construction, which is simple to manufacture, may be used. The contactors which can be clamped onto the edges can easily be adapted to the required application of the fuse. Thus the outer ends of the contactors may extend or be bent down for insertion of the fuse into printed circuits, in such a way that they project from the underside of the carrier as plug-in tongues, lugs or other terminal contacts.

Preferably the carrier is produced from flat material. For further simplification of manufacture, it is advantageously provided that a plurality of the carrier panels are produced from the flat material in the form of an integral strip from which, depending upon the number of fusible conductors which are to be arranged on the carrier in the direction of the width, pieces of corresponding length may be separated. In this way there is enabled not only a continuous strip manufacture of the carrier, but depending upon the choice of the length of the carrier which is to be separated from the strip, two or more fusible conductors may be applied to the carrier. This is useful if a spare fuse is required in the case of single phase fusing, by replugging or resoldering, or if fusing of two supply leads is desired.

The storage of the strip of carrier panels can moreover be simplified if the flat material is resilient in such a way that the strip can be rolled up.

Furthermore the flat material should be able to be coated by means of the thin-film technique.

The catch members may be moulded integrally with the cover and comprise a pair of spaced opposed clips which are spreadable resiliently apart and which ride over and snap underneath opposed edge parts of the carrier upon assembly of the cover onto the carrier. This construction of the cover simplifies the production of the housing necessary for the protection of the fusible conductor, in that the two components are merely pressed together, whereupon the clips are first of all spread apart and in their final position lock the cover onto the carrier. For this purpose the carrier advantageously has notches at its opposed edge parts and the clips engage through the notches. In this way the carrier and the cover form a housing having a smooth outer wall and the seating of the clips against the carrier is predetermined.

Preferably further notches are provided on the carrier, arranged at its corners, and correspondingly shaped dogs projecting from the edge of the cover engage in these corner notches to center the carrier and cover. When the carrier panel is produced in strip form both the notches intended for the clips and also those for the dogs are advantageously chosen to be twice as wide and the dividing line for the separation of individual carrier panels from the strip runs through the center of these double-width notches.

If the formation of a housing is required in which the cover does not touch the fusible conductor, irrespective of whether the fusible conductor is printed on the carrier or is applied in a suitable way as a fusible conductor wire, the cover may seat against the carrier by a sidewall running all round the edge of the cover and carrier and moulded in one piece with a panel of the cover. An extremely flat housing box is then formed having a rectangular or square outline.

Preferably the contactors are provided at opposed edge parts, and a mechanical connection is provided between each end of the fusible conductor, which extends across the surface of the carrier, and a respective one of the contactors by means of spring or clamping pressure. Contactors of this kind may be employed both for fusible conductors printed onto the carrier and also for those of fusible wire.

In particular for the production of an electrically conductive connection to a fusible conductor consisting of wire and for simultaneously fastening of it to the carrier, each contactor may be formed out of sheet metal and have a substantially U-shaped body which embraces the edge of the carrier and a free end which is bent over to clamp the respective end of the fusible conductor against a part of the U-shaped body overlying the carrier. If the free end lies at an appropriate distance from the edge of the carrier, the free leg may at the same time ensure a firm seat of the contact against the carrier, as a result of engagement of the free leg behind the sidewall of the cover. The contactor is then unable to be withdrawn, as long as the cover is fastened to the carrier.

The end of each contactor remote from the fusible conductor is advantageously made as a prong projecting out from the carrier. It may optionally serve as a plug in the case of insertion of the fuse or as a terminal for soldering of connections.

In order to associate with the contactor a certain space at the edge of the carrier and at the same time to ensure that they cannot be shifted, it is advantageous if the surface of the carrier adjacent to the fusible conductor is provided at each of its opposed edge parts with a recess which acts as a seat for the respective contactor.

In the case of the construction of a fuse with a number of fusible conductors, a number of the carriers are advantageously constructed in one piece, arranged side by side, e.g. by appropriate separation of the strip of flat material, and are covered by a single cover of corresponding size. Preferably the covers consist of transparent material so that any breakdown of the fusible conductor can more easily be established.

The invention creates the prerequisites for fully automatic production of fusible conductors which because of the simple construction and the chosen way of connection can be realised with comparatively low outlay.

Some example of fuses constructed in accordance with the invention are illustrated in the accompanying drawings, in which.

Figure 1:
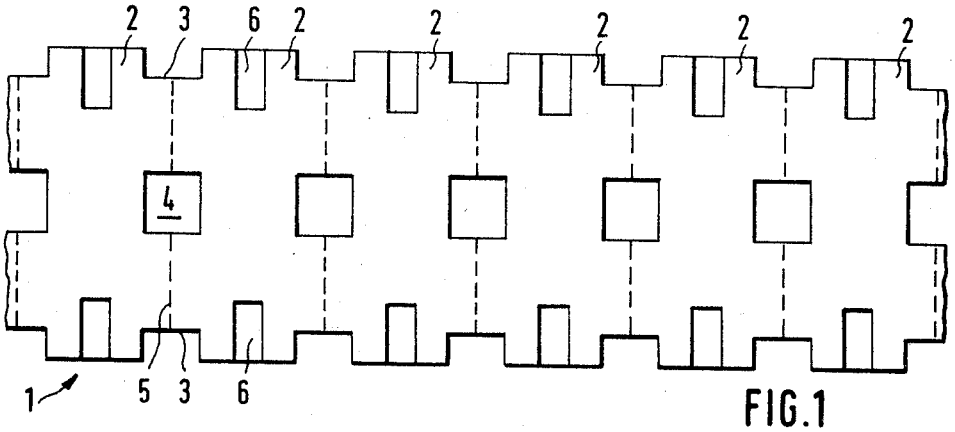
FIG. 1 is a plan of a number of carriers for a fuse, connected together in the form of a strip.
Figure 2:
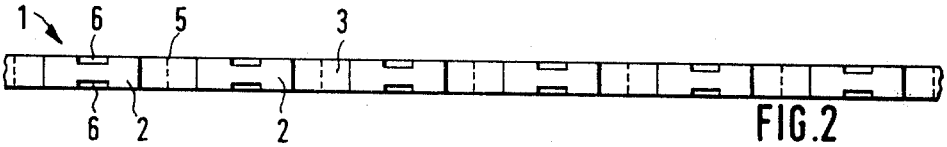
FIG. 2 is a side elevation of the strip in accordance with FIG. 1.

In FIG. 1 is illustrated part of a strip of elastic rollable flat material of insulating material, designated as a whole by 1, from which are made carriers or support members 2 for individual or multiple fuses, connected directly together in a regular sequence. The strip 1 exhibits at the edges notches 3 lying opposite one another in respective pairs as well as apertures 4 lying between them and on the longitudinal centerline of the strip. Lines of Break 5 run in the direction of the width of the strip through the centers of the notches 3 and apertures 4. Between the notches 3 on both surfaces of the strip 1 recesses 6 are arranged lying opposite one another in respective pairs (FIGS. 1 and 2).

Figure 6:
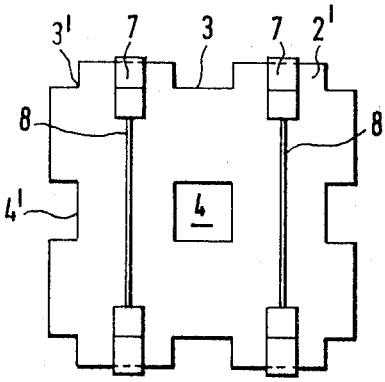
FIG. 6 is a plan of a carrier provided with fusible conductors and contacts for a double fuse.
Figure 7:
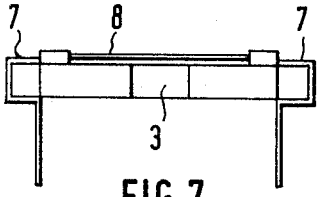
FIG. 7 is a side elevation corresponding to FIG. 6.

The carriers 2 may be separated from the strip 1 in a simple manner along the lines of break 5, that is, either for single fuses (FIG. 3) or else for double fuses (see the carrier 2' in FIGS. 6 and 7).

Figure 3:
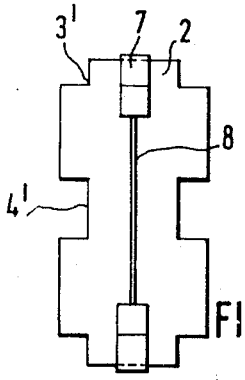
FIG. 3 is a plan of a carrier provided with contacts and fusible conductor for a single fuse.
Figure 4:
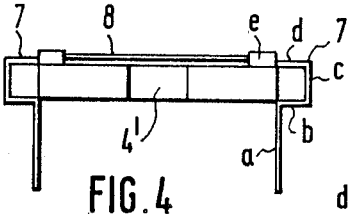
FIG. 4 is a side elevation of the carrier as FIG. 3.

A fusible conductor 8 in wire form is fastened to the carrier as shown in FIGS. 3 and 4 by means of contactors 7 plugged firmly onto the recesses 6 at the edge of the carrier or support member 2. The contactors are produced out of a stampable essentially L-shaped strip 9 of sheet metal (FIG. 5) in a simple bending process in which parts a, b, c, d, and e are formed. The seating of a U-shaped body, provided by the parts b, c and d, on the carrier 2 may be seen in FIGS. 3 and 4. Upon bending round the free end part e onto the part d, the end of the fusible conductor 8 associated with the respective contactor 7 gets clamped firmly in so that the necessary electrical and mechanical connection is produced. The fusible conductor 8 thus runs at a short distance above the surface of the carrier 2.

It may be mentioned merely by way of example, that the thickness of the carrier may amount to about 1.5 mm, its width to about 7.5 mm. and its length to about 15 mm. The free end part a remote from the fusible conductor 8 serves as a connection lug or tongue and may even be employed directly as a plug.

Figure 5:
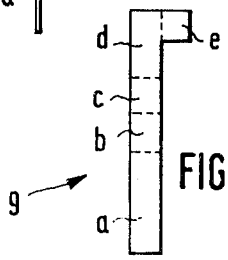
FIG. 5 is a plan of a piece of sheet metal serving for the production of the contacts.
Figure 8:
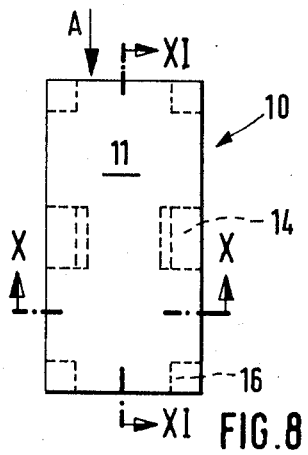
FIG. 8 is a plan of a cover for a single fuse.

The example in accordance with FIG. 6 and 7 differs from the example of FIGS. 3 and 5 merely in that for the formation of a double fuse a double-width carrier 2' is separated from the strip 1 and two pairs of contactors 7 as well as two fusible conductors 8 are provided.

Figure 12:
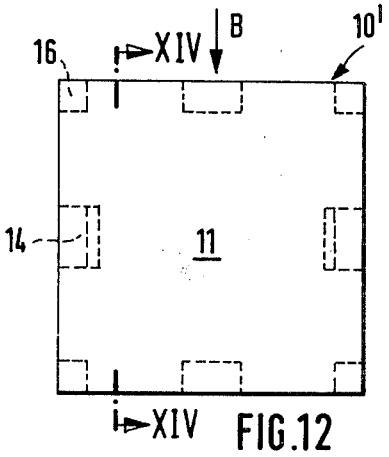
FIG. 12 is a plan of a cover for a double fuse.
Figure 9:
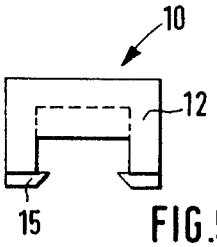
FIG. 9 is a side elevation of the cover of FIG. 8 as seen in the direction of the arrow A.
Figure 13:
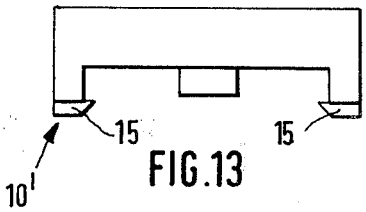
FIG. 13 is a side elevation of the cover of FIG. 12 as seen in the direction of the arrow B.
Figure 10:
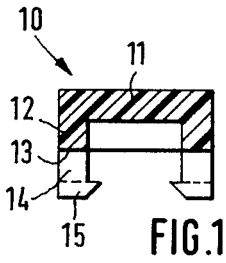
FIG. 10 is a section taken on the line X—X in FIG. 8.
Figure 14:
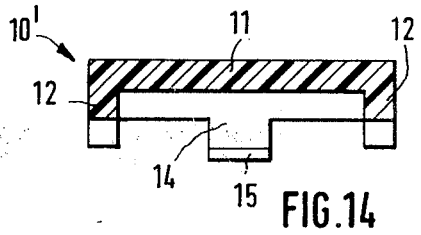
FIG. 14 is a section taken on the line XIV—XIV in FIG. 12.
Figure 11:
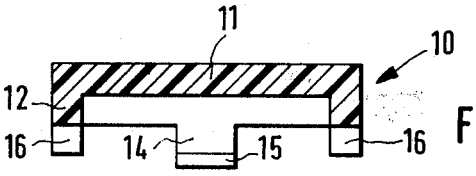
FIG. 11 is a section taken on the line XI—XI in FIG. 8.

FIGS. 8 to 11 show a cover member 10 for the carrier in accordance with FIGS. 3 and 4 (single fuse), and FIGS. 12 to 14 show a corresponding cover 10' for the carrier 2' (double fuse) of FIGS. 6 and 7. The covers 10, 10' consist of electrically insulating material which for better checking of the fuse, in particular of the fusible conductor 8, is transparent. A description of the cover 10 is sufficient since the cover 10' is intended merely for the larger carrier 2' and exhibits no fundamental structural differences.

The cover 10 exhibits a cover panel 11 with which is connected all round a sidewall 12, the underside 13 of which rests against the edge of the carrier 2 and at the same time clamps against the parts d of the contactor 7, while the small elevation which is formed by the free end part e of each contactor 7, bent onto the part d, engages behind the inside of the wall 12.

At the longer sides of the cover 10 the sidewall 12 continues into a pair of clips 14 lying opposite one another, each of which has at its free end a foot 15 projecting inwards and having a bevelled leading edge. On the same side of the cover 10 there are at the four corners dogs 16 projecting downwards, the construction of which is complementary to the notches 3' at the corners of the carrier 2, which in turn arise from the notches 3 in the strip 1. Correspondingly the shape of the clips 14 are complementary to notches 4' in the carrier 2 respectively, the notches 4' arising from the notches 4 in the strip 1 upon separation of the carriers 2 respectively.

For the formation of a fuse housing for the fastening and protection of the fusible conductor 8, the cover 10 is merely rested upon the ready-mounted carrier 2 in accordance with FIGS. 3 and 4 and the two components are pressed together in such a way that the clips 14 are first of all spread resiliently outwards and then snap in by the projecting part of the foot 15 in each case underneath the carrier 2, while the dogs 16 on the cover 10 engage in the recesses 3' at the four corners of the carrier 2 and strengthen the mutual connection and assist the mutual centering of the carrier 2 and cover 10. The mounting of the cover 10' on the carrier 2' for the production of a double fuse is in a similar way. In both cases the fusible conductors 8 run freely and without touching the carrier 2 or 2' respectively or the cover 10 or 10' respectively between the contactors 7. The feet 15 of the clips projecting at the underside of the carrier at the same time serve to keep a clearance from the printed circuit, so that vapours from soldering can escape. The smooth surface of the cover panel 11 provides the opportunity of labelling the housing with the necessary rated data, for example, by means of screen printing. A dusttight connecting may be produced between the cover and the carrier by ultrasonic welding.

Figure 15:
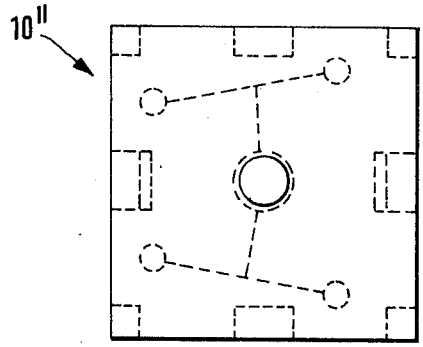
FIG. 15 is a plan of a cover made as a module-monitor.
Figure 16:
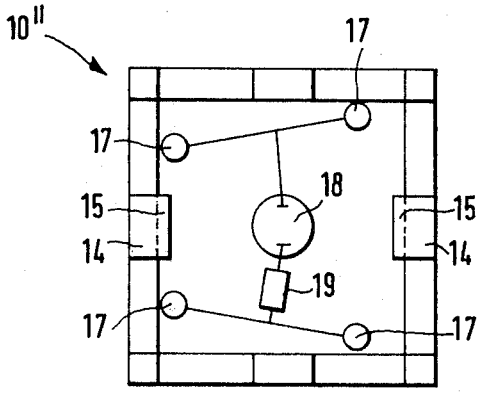
FIG. 16 is a view of the underside of the cover as FIG. 15 with the electrical components arranged upon it; and, FIG. 17 is a side elevation corresponding to FIG. 16.
Figure 17:
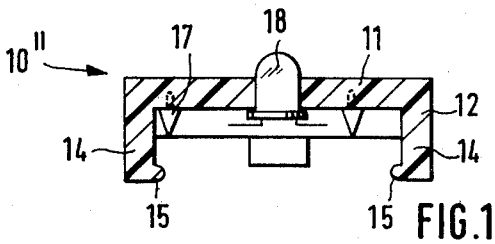

The invention may also be applied to fuses having optical indication of the state of the fuse. For doing this it merely needs the additional components in the cover 10'' which may be seen from FIGS. 15 to 17. Four contact pins 17 are arranged in corresponding holes drilled in the positions shown on the inside of the cover panel 11 and as shown are connected together in pairs, as well as to a light-emitting diode or glowlamp 18 inserted in the center of the cover panel 11, and a resistor 19. By plugging on the cover 10'' turned through 90° a bright or dark switching can be realized at option, where in the latter case only one fusible conductor 8 must be used in order to guarantee the operation.

What I claim is:

1. In an electrical fuse comprising a carrier of electrically insulating material; a cover of electrically insulating material; means attaching said cover to said carrier to define therewith a housing of electrically insulating material; spaced contactors extending from within to outside of said housing for connecting said fuse into an electrical circuit; and a fusible conductor connecting said contactors within said housing, the improvement wherein said carrier is in the form of a panel of flat material; said contactors are clamped firmly onto an edge of said carrier; and said cover has spacer projecting parts resting against said carrier to provide a clearance between said cover and said carrier to accommodate said fusible conductor, and projecting catch members comprising said means for attachment of said cover to said carrier.

2. A fuse according to claim 1, wherein said flat material has been coated by means of the thin-film technique.

3. A fuse according to claim 1, wherein said catch members are moulded integrally with said cover and comprises a pair of spaced opposed resilient clips capable of being spread resiliently apart such that upon assembly of said cover onto said carrier the resiliently spread apart clips ride over and snap beneath and engage opposed edge parts of said carrier.

4. A fuse according to claim 3, wherein said carrier has notches at its opposed edge parts and said clips engage through said notches.

5. A fuse according to claim 1, wherein said carrier has notches at corners thereof and correspondingly shaped dogs project from the edge of said cover and engage in said corner notches to center said cover relatively to said carrier.

6. A fuse according to claim 1, wherein said spacer projecting parts comprise parts of a sidewall extending along the edge of said carrier.

7. A fuse according to claim 6, wherein said sidewall is integrally moulded with said cover.

8. A fuse according to claim 1, wherein said contactors are disposed at opposed edge parts of said carrier, and a mechanical connection between each end of said fusible conductor, which extends across a surface of said carrier, and a respective one of said contactors by means of spring or clamping pressure.

9. A fuse according to claim 8, wherein each of said contactors is formed out of sheet metal and has a substantially U-shaped body which embraces said edge of said carrier and a free end which is bent over to clamp the respective end of said fusible conductor against a part of said U-shaped body overlying said carrier.

10. A fuse according to claim 8 or claim 9, wherein an end of said contactor remote from said fusible conductor comprises a prong projecting out from said carrier.

11. A fuse according to claim 8, wherein said carrier surface adjacent to said fusible conductor has at each of said opposed edge parts a recess defining a seat for a respective one of said contactors.

12. A fuse according to claim 11, wherein said recesses are provided on both opposed surfaces of said carrier.

13. A fuse according to claim 1, wherein there are a plurality of said fusible conductors carried side by side on an integral array of a corresponding number of said carriers, and covered by a single cover of corresponding size.

14. A fuse according to claim 1, including an ultrasonically welded dusttight connection between said carrier and said cover.

15. A fuse according to claim 1, including an optical indicator for indicating the operative state of the fuse.

16. An electrical fuse comprising: a carrier in the form of a panel of flat electrically insulating material; a cover made of electrically insulating material and incorporating a panel, a sidewall depending from an edge of said cover panel, and catch members depending from said cover panel for attaching said cover to said carrier with said sidewall abutting an upper surface of said carrier thereby to provide between said cover panel and said carrier upper surface a housing cavity; a pair of contactors clamped between said cover sidewall and said carrier upper surface and extending from within said housing cavity downwardly from said carrier for connecting said fuse into an electrical circuit; and a fusible conductor extending across said carrier upper surface within said housing cavity and connected at its ends to said contactors.

17. An electrical fuse comprising: an electrically insulative housing comprised of a flat support member and a cover member removably attached to the support member and defining therewith the housing, the cover member having a cover panel, a sidewall projecting from the cover panel and abutting against the support member, and a set of resilient clips projecting from the sidewall and resiliently clamping the cover member to the support member; at least one pair of spaced contactors connected to said support member and extending from within to outside the housing for connecting the fuse to an electric circuit; and a fusible conductor electrically connecting each pair of spaced contactors within the housing.

18. An electrical fuse according to claim 17; wherein each contactor comprises a sheet metal piece having one end bent over and clamped to one end of the fusible conductor in electrical connection therewith and having another end extending outside the housing.

19. An electrical fuse according to claim 17 or 18; wherein the support member has recessed portions configured to receive therein respective ones of the contactors to position the pairs of contactors in spaced relation.

20. An electrical fuse according to claim 17 or 18; wherein the cover member sidewall projects from a peripheral edge of the cover panel and extends completely around the periphery of the cover panel.

* * * * *